United States Patent [19]

Papoff et al.

[11] 3,981,487

[45] Sept. 21, 1976

[54] DEVICE FOR MIXING LIQUIDS IN KINETIC REACTIONS OBSERVED BY THE METHOD KNOWN AS STOPPED FLOW

[75] Inventors: Paolo Papoff; Basilio Morelli, both of Bari, Italy

[73] Assignee: Consiglio Nazionale delle Richerche, Rome, Italy

[22] Filed: Jan. 16, 1975

[21] Appl. No.: 541,410

[52] U.S. Cl. ..... 259/4 R

[51] Int. Cl.[2] ..... B01F 15/00; B01F 15/02

[58] Field of Search ..... 259/4, 2, 18, 36, 60

[56] References Cited

UNITED STATES PATENTS

| | | | |
|---|---|---|---|
| 3,220,801 | 11/1965 | Rill, Jr. et al. | 259/4 R |
| 3,752,444 | 8/1973 | Foucault | 259/2 |
| 3,771,963 | 11/1973 | Breer | 259/4 R |
| 3,883,121 | 5/1975 | Guillard | 259/4 R |

FOREIGN PATENTS OR APPLICATIONS

| | | | |
|---|---|---|---|
| 761,466 | 3/1934 | France | 259/18 |

*Primary Examiner*—Stanley N. Gilreath
*Assistant Examiner*—Donald B. Massenberg
*Attorney, Agent, or Firm*—Haseltine, Lake & Waters

[57] ABSTRACT

The device comprises a housing 16, having an annular chamber 18, the outer walls whereof are connected with conduits 10 and 12 to feed the liquids to be mixed; and the inner walls whereof with radial, conical conduits 24 and 26 which are perpendicular to the first mentioned conduits and which lead into a central chamber 28. Said central chamber 28 communicates by assymetric conduits 48, 50 with observation cell 40.

6 Claims, 3 Drawing Figures

DEVICE FOR MIXING LIQUIDS IN KINETIC REACTIONS OBSERVED BY THE METHOD KNOWN AS STOPPED FLOW

This invention relates to a device for the controlled mixture of liquids in chemical/physical analyses, said device being apt to reveal the rapid kinematic reactions of two or more liquids and which occur both during and after mixture of the liquids involved.

Devices of this type are commonly known in the art as "stopped flow" devices, used in photometric, conductimetric, calorimetric and similar analyses.

The known types of apparatus used for this purpose have a number of drawbacks and limitations, caused mainly by dead times i.e. the time lapsing between the start and finish of the mixing phase.

The purpose of this invention is to obviate the above and other drawbacks by providing a device that will permit uninterrupted and thorough mixing of two liquids to be examined in very brief and controllable periods of time.

A further object of the invention is to provide device of the type specified with the simplest possible structure in order to facilitate, in addition to its fabrication, also maintenance and checking of its components and which is apt to consent at the same time, the reproduction of such characteristics as may be required from time to time by the liquid analyzed.

The device according to this invention is characterized by an annular chamber communicating in at least two diametrically opposite points with the feeding conduits for the liquids to be mixed and with at least two radial conduits conveniently offset at an angle with respect to the former's and with their outlets in or adjacent to the bottom compartment of a central chamber which is co-axial with said annular chamber and extending axially beyond the latter to communicate by at least two asymmetrical conduits with the observation cell so that the two liquids to be mixed will at first flow through curved paths in opposite directions to meet and then flow centripetally through the radial conduits, hence deviate into the central chamber and flow axially from here, into the observation cell.

In one advantageous form of embodiment of the device, the cross sections of the diametrically opposite centripetal radial conduits is decreasing, starting from the inlet openings toward the outlet openings i.e. toward the axis of the central chamber which leads into an expansion chamber from which depart a plurality of conduits leading with their inclined convergent axes to an opening of the observation cell.

In order to ensure thorough mixing of the samples to be examined at least a part of the asymmetrical conduits are combined with complementary conducts the axes of which are perpendicular to the axes their related asymmetrical conduits.

The invention will now be described in conjunction with the attached drawings illustrating, only by way of example, one preferred form of embodiment of the device.

Figure 1:
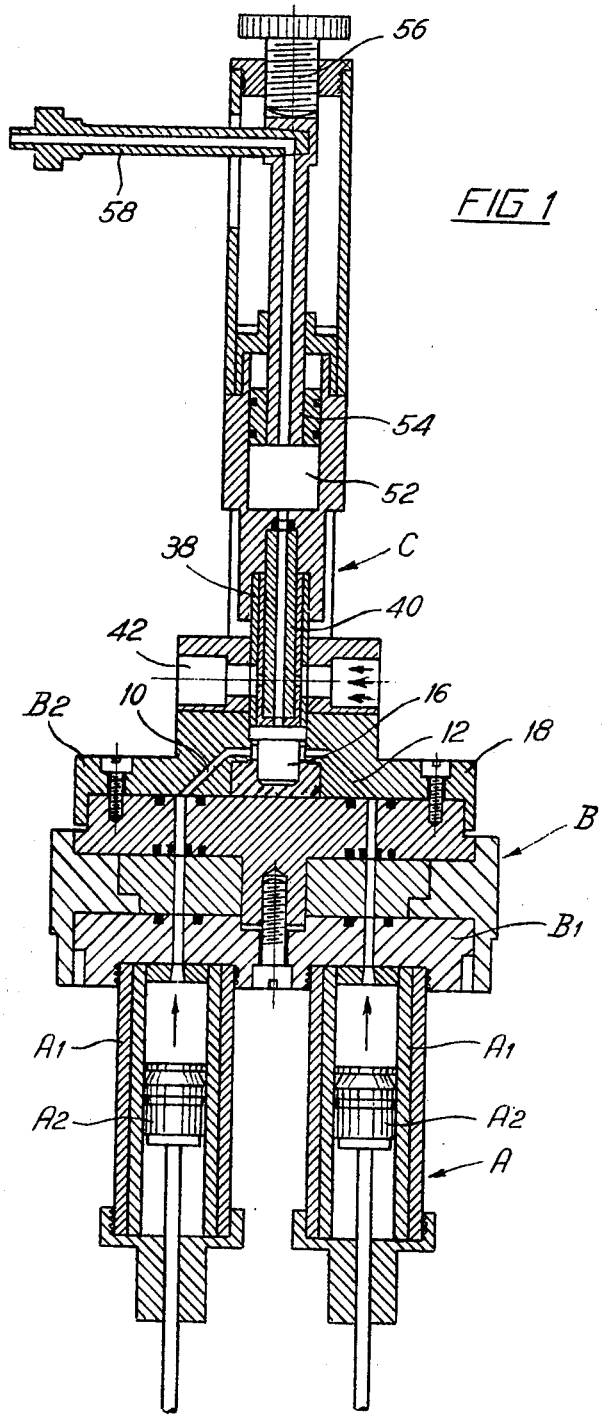
FIG. 1 is an axial cross sectional view of an analysis unit provided with the device according to the invention.

The analysis unit shown in FIG. 1 comprises an injector assembly A with cylinder A1 — piston A2 assemblies secured to one of the parts B1 of a switchable shut-off device B, the conjugate part B2 of which is provided with two pairs of conduits of which only one; 10–12 is shown, whilst the other pair is offset by 90° with respect to the first pair.

Said two pairs of conduits connect cylinders A1, respectively with observation cell C and with containers (not shown) for the liquids to be examined.

Cylinders A1 of the injector assembly A are provided with pistons A2 simultaneously and conveniently actuated by a motor, as described, for example, in another patent by the same authors.

Figure 2:
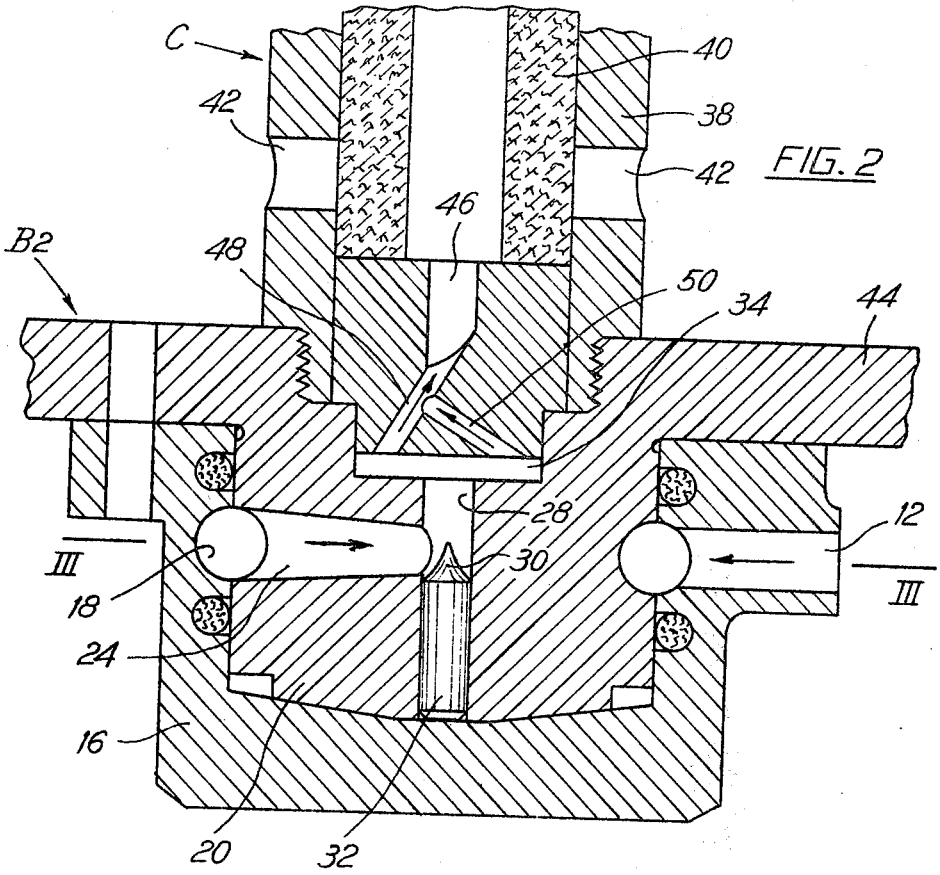
FIG. 2 is a large scale cross sectional view of the device taken along lines II—II of FIG. 3.
Figure 3:
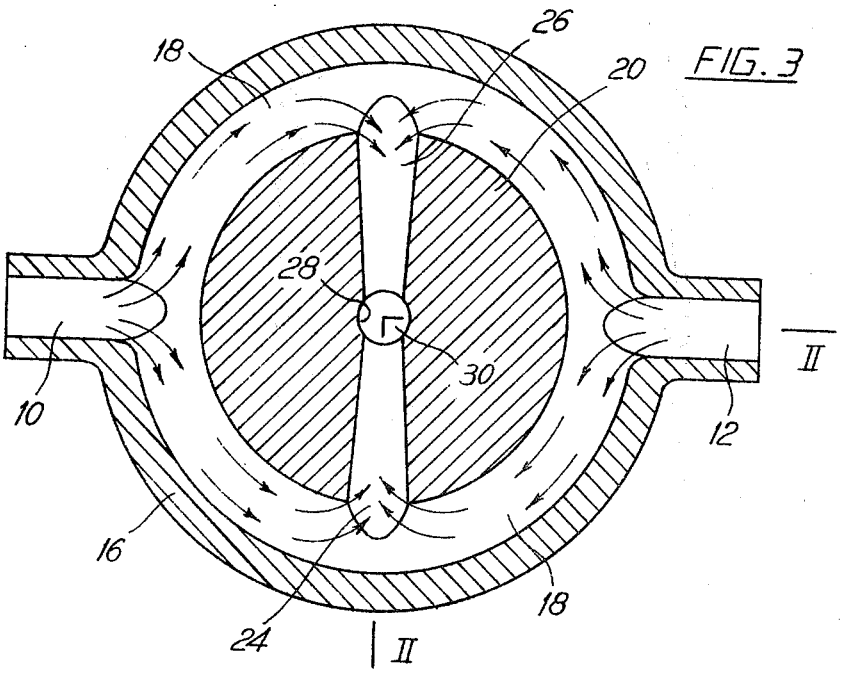
FIG. 3 is a cross sectional view of the device taken along lines III—III of FIG. 2.

The two sections B1 and B2 of shut off device B may be rotated reciprocally to establish alternatively communication of the interior of cylinder A1 with the containers of the liquids to be analysed and with conduits 10 and 12; in the latter case, when the pistons shift, the two liquids are simultaneously injected in the mixing chamber of the mixing device situated below observation cell C and which will now be described in detail:

With reference to FIGS. 2 and 3 the mixing device carried by cell C comprises a shell 16 conveniently secured to the base of said cell and in which the terminal sections of conduits 10 and 12 are diametrally opposite and connectable to cylinders A; said conducts outlet in diametrally opposite position in an annular groove 18 situated in a convenient position and located partly inside shell 16 and partly outside a cylindrical head 20 working in tight seal relationship in the cavity of said shell and therein conveniently secured.

Cylinder head 20 is provided with radial holes 24 and 26, the centerlines of which are aligned and hence diametrally opposite and perpendicular to the terminal parts of conduits 10 and 12.

Holes 24 and 26 outlet adjacent to the bottom of a central chamber 28 formed by a recess or hole topped in head 20.

Diametral holes 24 and 26 are tapered with decreasing cross section toward chamber 28 in consideration of what will be stated below.

The bottom of central chamber 28 is located opposite the lower openings of holes 24 and 26 and consists of a baffle 30 shaped like a concave spindle the centerlines of which coincides with the axis of central chamber 28. Specifically, baffle 28 is machined on one end of a spindle 32 which is housed with a very narrow tolerance in the lower part of hole 28 in such manner that the base of the taper end of the spindle is situated at equal level with the lower outlet edges of holes 24 and 26 whilst the apex of the taper is opposite or slightly above the intersection point of the centerlines of said spindle 32 and said holes 24 and 26, as shown in FIG. 2. Central Chamber 28 leads into an expansion chamber 34, in the upper part of head 20; said chamber is closed by the lower end of a cylindrical block 36 fitted into the lower part of a tube 38 into which is also fitted a sleeve 40 of suitable transparent material. Tube 38 is provided with diametrically opposite openings in suitable positions, which permit visualization of the actual mixing process and/or reaction of the liquid which takes place in sleeve 40.

Tube 38 is secured by the most convenient means to plate 44 to which is also secured the previously considered head 20.

Cylindrical block 36 also has in its upper part an axial hole 46 the lower connects with one or more asymmetrical holes 48 which are inclined so as to diverge downward and lead into the periphery of expansion chamber 34.

At least a part of the asymmetrical holes 48 are combined with one or more transversal holes 50 the centerlines of which are substantially perpendicular to the centerlines of the related asymmetrical hole 48 and which lead, from one end into the center area of said hole and from the other end into the periphery of expansion chamber 34.

In view of the particular arrangement of the parts of the device, it ensures that mixing of the liquids takes place thoroughly and completely, thereby constantly ensuring complete reliability of the analysis. In fact, again considering FIG. 1, the liquids in cylinders A1 are quickly delivered into conducts 10–12 by the shifting of pistons A2 and the two liquid flows are conveyed in radially opposite directions into annular chamber (18) wherein said flows are split in two opposite directions as shown by the arrow in FIG. 3.

The liquids in channel 18 flow through curbed tracts of approx 90°, after which they meet at the inlet openings of tapered holes 24 and 26; in this way a first effective mixture is performed, considering that the two flows shift in opposite directions and, in meeting, invert their flow directions by 90°.

The mixture obtained flows through conical holes 24 and 26 with increasing velocity toward the terminal ends of the holes, in view of their tapered section.

The flows of the first mixture on discharging from holes 24 and 26 strike baffle 30 and are deviated along the axis of central chamber 28, thereby undergoing a further mixing; the mixture obtained at the outlet of central chamber 28 fills expansion chamber 34.

The liquid mixture then flows from chamber 34 through asymmetric conduits 48, into hole 46 and then into transparent sleeve 40 of observation cell C, to be examined through windows 42.

It should be noted that in flowing from chamber 34 to element 40 the liquid is subjected to a further thorough mixing; in fact jets determined by the liquids from transversal conduits 50 are injected into the fluid streams flowing through asymmetric conduits 48 and which jets cut said main flows perpendicularly.

It is thus possible to considerably reduce the so called dead time during analyses involving the mixture of two liquids or other related analyses, so as to obtain accurate and reliable results.

It is obvious that modifications and changes may be introduced to meet end use requirements; for example, diaphrams to govern the deviation of the fluid streams in the various conduits may be provided at the ends of conducts 10, 12 and 24, 26.

Moreover, asymmetrical conduits 48 and complementary conduits 50 may be provided with conveniently differentiated cross sections.

The present invention also covers the observation cell incorporating the device according to the invention.

It is understood that the details of the device may be varied to meet particular requirements without departing, however, from the spirit and scope of the invention.

We claim:

1. Mixing device for liquids employing the stopped flow method comprising injecting liquids through a mixing chamber then into an observation cell or chamber, comprising an annular chamber connected with at least two diametrically opposite supply or feed conduits for the liquids to be mixed with at least two diametrically opposite radial ducts of gradually decreasing cross-section in direction of flow and conveniently offset with respect to said supply or feed conduits so as to invert liquid flow direction by 90° and leading into the bottom wall of a central chamber which is co-axial with said annular chamber extending axially beyond the latter and communicating by asymetrical conduits with an observation cell whereby the liquids to be mixed will at first flow through curved paths in opposite directions then meet and flow centripetally through the radial conduits, to be deviated axially into a central chamber and then flow axially into said observation cell.

2. Mixing device as in claim 1, wherein said bottom wall of said central chamber is shaped like a spindle the apex of which coincides with the centerline of said conduit so that the radial centripetal liquid flows are deviated in and axial direction within said central conduit.

3. Mixing device as in claim 1, wherein there is an expansion chamber between the discharge point of said central chamber and the inlet of said observation cell.

4. Mixing device as in claim 1, wherein communication between said central chamber and said observation cell is effected by means of first which converge toward the opening of said observation cell.

5. Mixing device as in claim 1, wherein the supply or feed conduits are connectable by means of switchable shut off devices between the containers for the mixture components and the mixing chamber and by the use of injector feeders.

6. Mixing device as in claim 5 wherein said convergent second conduits are asymmetric to complementary conduits with the central axes of said first and second conduits substantially perpendicular to one another.

* * * * *